US008823600B2

(12) United States Patent
Swais et al.

(10) Patent No.: US 8,823,600 B2
(45) Date of Patent: Sep. 2, 2014

(54) SPRING CONTACT ASSEMBLIES AND SEALED ANTENNA BASE ASSEMBLIES WITH GROUNDING TAPS

(75) Inventors: Imad M. Swais, Bloomingdale, IL (US); Robert K. Antonio, Lake Zurich, IL (US)

(73) Assignee: Laird Technologies, Inc., Earth City, MO (US)

( * ) Notice: Subject to any disclaimer, the term of this patent is extended or adjusted under 35 U.S.C. 154(b) by 407 days.

(21) Appl. No.: 13/236,382

(22) Filed: Sep. 19, 2011

(65) Prior Publication Data

US 2013/0069845 A1 Mar. 21, 2013

(51) Int. Cl.
*H01Q 1/12* (2006.01)
*H01Q 1/42* (2006.01)

(52) U.S. Cl.
CPC ... *H01Q 1/12* (2013.01); *H01Q 1/42* (2013.01)
USPC ..... 343/878; 343/713; 343/882

(58) Field of Classification Search
CPC ..... H01Q 1/12; H01Q 1/42; H01Q 5/34; H01Q 9/34
USPC ..... 343/872, 711, 713, 715, 878, 880, 882
See application file for complete search history.

(56) References Cited

U.S. PATENT DOCUMENTS 4,115,779 A 9/1978 Dantzler et al.
5,977,931 A 11/1999 Openlander
6,292,156 B1 9/2001 Openlander
6,930,643 B2 8/2005 Byrne et al.
7,268,734 B2 9/2007 Cislo
7,339,548 B2 * 3/2008 Cislo ..... 343/878
7,439,932 B2 * 10/2008 Lin ..... 343/882

OTHER PUBLICATIONS

MBO16394 NMO Mount, High Frequency, High Performance Performance Permanent 3/4 NMO Mount; Copyright 2009; 2 pages.
Multi-band Mobile Antenna WPD136M6C-001; Copyright 2009; 2 pages.

* cited by examiner

*Primary Examiner* — Tho G. Phan
(74) *Attorney, Agent, or Firm* — Harness, Dickey & Pierce, P.L.C.

(57) ABSTRACT

An exemplary embodiment of an antenna assembly mountable to an antenna mount having a contact, generally includes a printed circuit board (PCB) and a contact assembly configured to provide a solderless connection between at least one antenna element of the PCB and the contact when the antenna assembly is mounted to the antenna mount. Another exemplary embodiment of an antenna assembly generally includes a base and a housing configured to be coupled to the base such that an interior enclosure is cooperatively defined by the housing and base. The interior enclosure is configured for receiving a PCB and being sealed to thereby inhibit the ingress of water into the interior enclosure. One or more electrical grounding taps are configured for establishing at least a portion of an electrically-conductive grounding pathway from outside of or external to the interior enclosure and which extends into the interior enclosure.

24 Claims, 12 Drawing Sheets

SPRING CONTACT ASSEMBLIES AND SEALED ANTENNA BASE ASSEMBLIES WITH GROUNDING TAPS

FIELD

The present disclosure generally relates to antennas and more specifically (but not exclusively) to spring contact assemblies and sealed antenna base assemblies with electrical grounding taps and methods of using the same.

BACKGROUND

This section provides background information related to the present disclosure which is not necessarily prior art.

Multiband antennas typically include multiple antennas to cover and operate multiple frequency ranges. A printed circuit board (PCB) having a radiating antenna element thereon is a typical component of a multiband antenna assembly. Another typical component of a multiband antenna assembly is an external antenna, such as a whip antenna rod. The multiband antenna assembly may be mounted to an antenna mount, which, in turn, is installed or mounted on a vehicle surface, such as the roof, trunk, or hood of the vehicle. The antenna mount may be interconnected (e.g., via a coaxial cable, etc.) to one or more electronic devices (e.g., a radio device, etc.), such that the multiband antenna is then operable for transmitting and/or receiving radio frequency signals to/from the radio device via the antenna mount.

SUMMARY

This section provides a general summary of the disclosure, and is not a comprehensive disclosure of its full scope or all of its features.

According to various aspects, exemplary embodiments are disclosed of contact assemblies and antenna assemblies including the same. For example, an exemplary embodiment includes a contact assembly suitable for providing a solderless connection between a contact of an antenna mount and a printed circuit board of an antenna assembly mountable to the antenna mount. In this example, the contact assembly generally includes a body, a contact member, a fastener for coupling the contact assembly to the printed circuit board, and a biasing member. The biasing member is operable for providing a biasing force for urging the contact member to slide relative to the body in a direction generally away from a closed end portion of the body when the biasing member is compressed between closed end portions of the contact member and body.

Another exemplary embodiment includes an antenna assembly mountable to an antenna mount having a contact. In this example embodiment, the antenna assembly generally includes a printed circuit board and a contact assembly. The contact assembly is configured to provide a solderless connection between at least one antenna element of the printed circuit board and the contact of the antenna mount when the antenna assembly is mounted to the antenna mount.

According to various aspects, exemplary embodiments are disclosed of antenna assemblies having sealed base assemblies with electrical grounding taps. For example, an exemplary embodiment includes an antenna assembly mountable to an antenna mount. In this example, the antenna assembly generally includes a base and a housing configured to be coupled to the base such that an interior enclosure is cooperatively defined by the housing and base. The interior enclosure is configured for receiving a printed circuit board therein and being sealed to thereby inhibit the ingress of water into the interior enclosure. The antenna assembly also includes one or more electrical grounding taps configured for establishing at least a portion of an electrically-conductive grounding pathway from outside of or external to the interior enclosure and which extends into the interior enclosure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
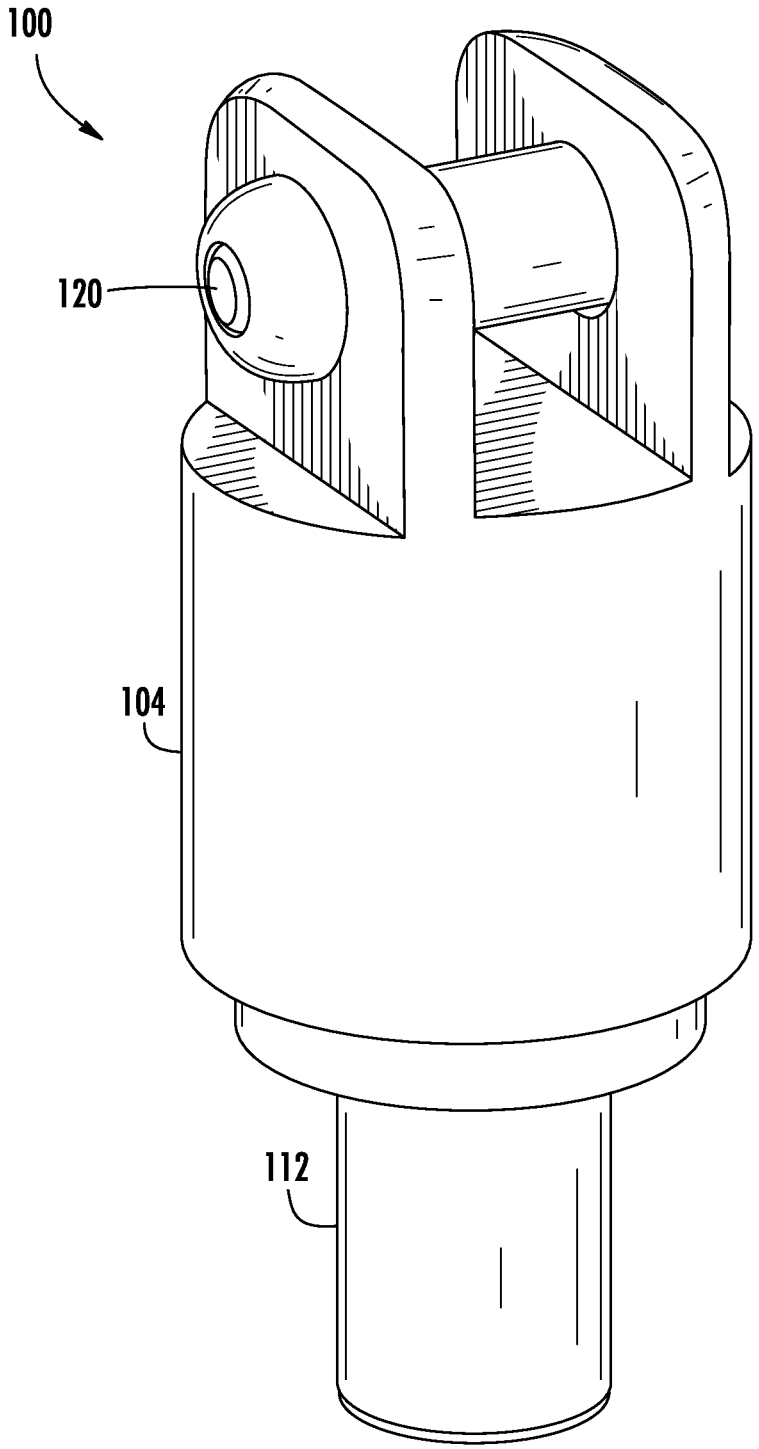
FIG. 1 is a perspective view of an exemplary spring contact assembly suitable for providing a solderless connection between a printed circuit board (PCB) and a center contact of an external antenna mount according to an exemplary embodiment.

Example embodiments will now be described more fully with reference to the accompanying drawings.

Disclosed herein are exemplary embodiments of spring contact assemblies suitable for providing a solderless connection between a printed circuit board (PCB) and a contact. In an exemplary embodiment, a spring contact assembly may be used to provide a solderless connection between a center contact (e.g., pin, etc.) of an external antenna mount and an internal antenna element on a PCB of a multiband antenna assembly. In such exemplary embodiment, the spring contact assembly thus may be used as a connecting device to physically interconnect (without soldering) the center contact from the external antenna mount to the internal antenna element, such that radio frequency (RF) signals, electrical current, and/or modulated RF signals may be transferred (transmitted, or received) via the spring contact assembly between the multiband antenna assembly and a radio device coupled to the antenna mount, such as via a coaxial cable. Additional aspects of the present disclosure also include methods of connecting a center contact from an external antenna mount to an internal antenna element of a printed circuit board without soldering.

In addition to the spring contact assemblies disclosed herein, there are also disclosed exemplary embodiments of sealed antenna base assemblies. The sealed antenna base assemblies may be used individually or in conjunction with a spring contact assembly, or either may be used individually. Accordingly, an antenna assembly may include either or both of a sealed antenna base assembly and/or a spring contact assembly according to aspects of the present disclosure.

Multiband antenna structures commonly include PCBs, which require electrical ground sources. Typically, the ground sources are fed at deferent locations at the base of the PCB. Conventionally, grounding sources have been made available but the inventors hereof have recognized that such convention methods breached the base of the antenna sacrificing the moisture and water seals. Accordingly, the inventors hereof have disclosed antenna base assemblies that provide the ground sources for the PCB while also maintaining a sealed base (e.g., a moisture, water, and/or dust sealed base, etc.). In an exemplary embodiment, there is an internal radiating element sealed foundation inside an antenna structure, which functions as an adaptor to mate an external antenna mount into the feeding point of a radiating element. This exemplary embodiment provides satisfactory multiple electrical grounding sources while preserving the sealing features. Additional aspects of the present disclosure also include methods of providing multiple electrical grounding sources for a printed circuit board without breaching the seal(s) of an antenna base assembly, thereby preserving the sealed interior of the antenna base assembly in which the printed circuit board is housed.

With reference now to the figures, FIGS. 1 through 8 illustrate an exemplary embodiment of a spring contact assembly 100 embodying one or more aspects of the present disclosure. As disclosed herein, the spring contact assembly 100 may be used in a multiband antenna assembly (e.g., 390 shown in FIG. 12, etc.) to provide a solderless connection between a printed circuit board (PCB) 124 (FIG. 2) (broadly, a substrate) and a center contact of an external antenna mount (e.g., center contact 397 of antenna mount 396 shown in FIG. 12, etc.). The spring contact assembly 100 may be used in conjunction with a sealed antenna base assembly, such as the sealed antenna base assembly 250 shown in FIG. 9. But the spring contact assembly 100 may also be used with other antenna base assemblies and/or other antenna assemblies than what is disclosed herein.

Figure 2:
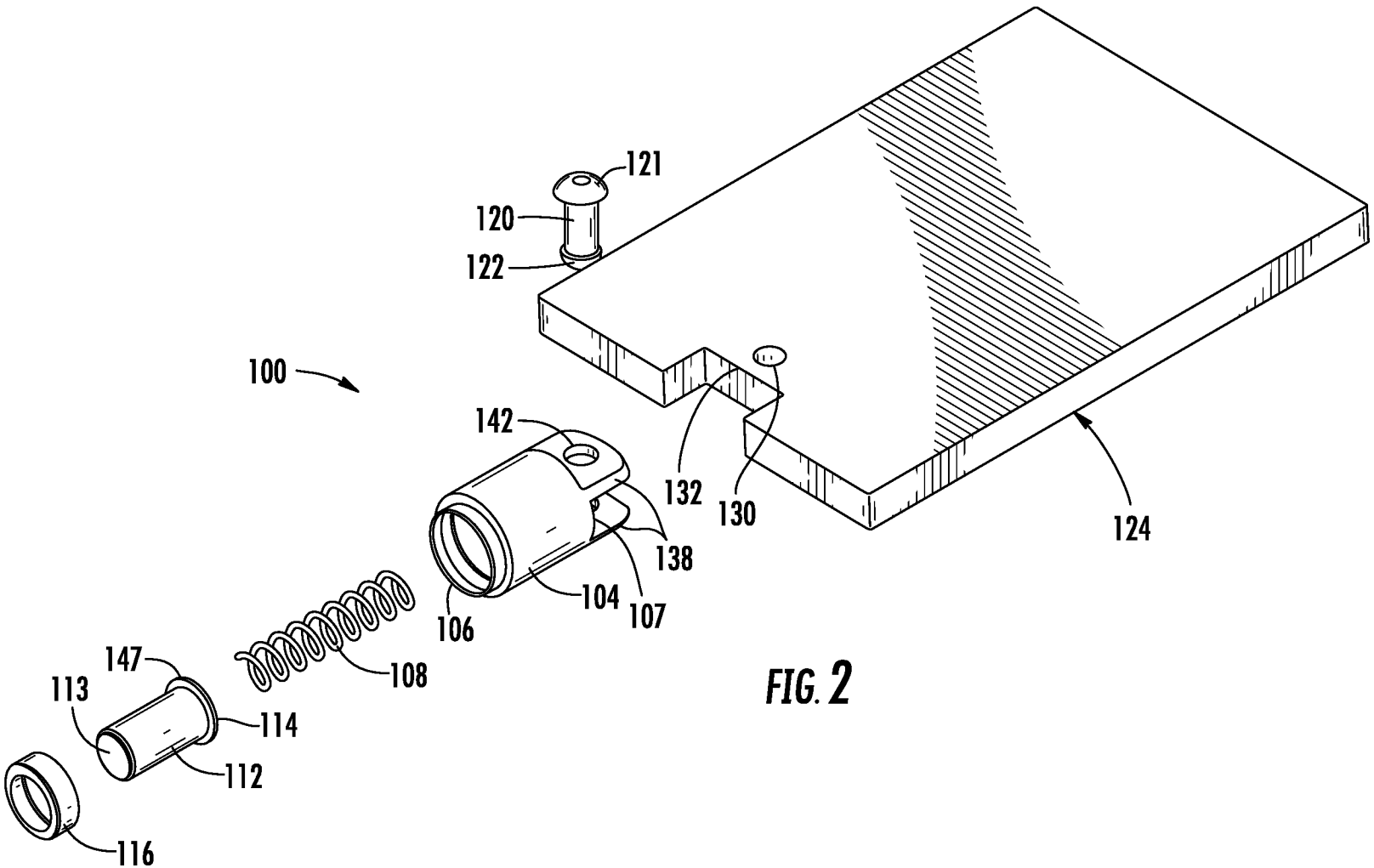
FIG. 2 is an exploded perspective of the spring contact assembly shown in FIG. 1, and also illustrating an exemplary PCB configured for use with the spring contact assembly according to an exemplary embodiment.
Figure 3:
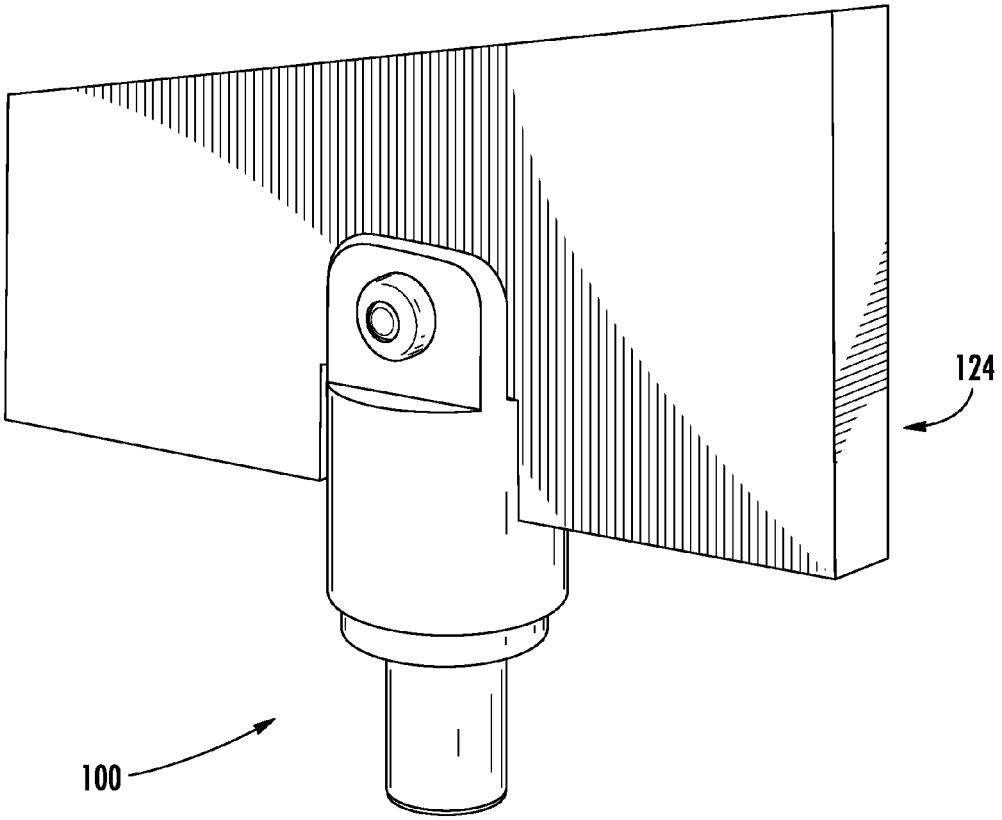
FIG. 3 is a perspective view illustrating the spring contact assembly coupled to the PCB shown in FIG. 2.
Figure 4:
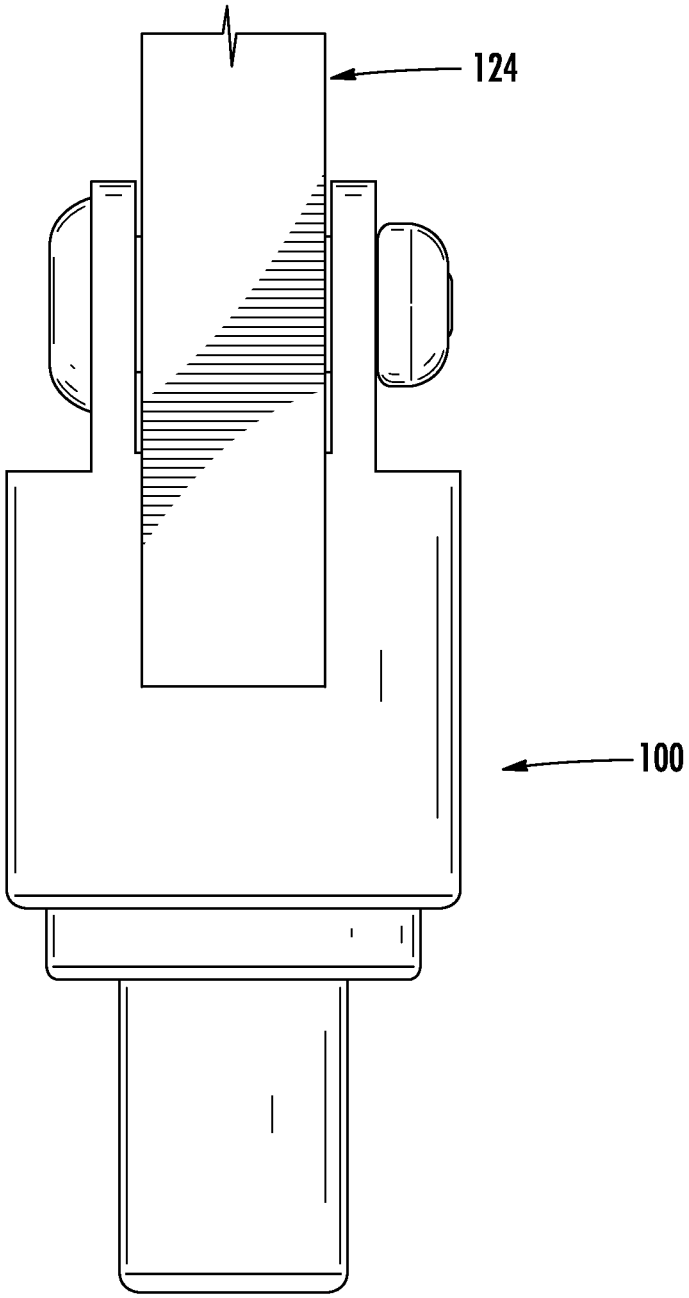
FIG. 4 is a side view of the spring contact assembly and PCB shown in FIG. 3.
Figure 5:
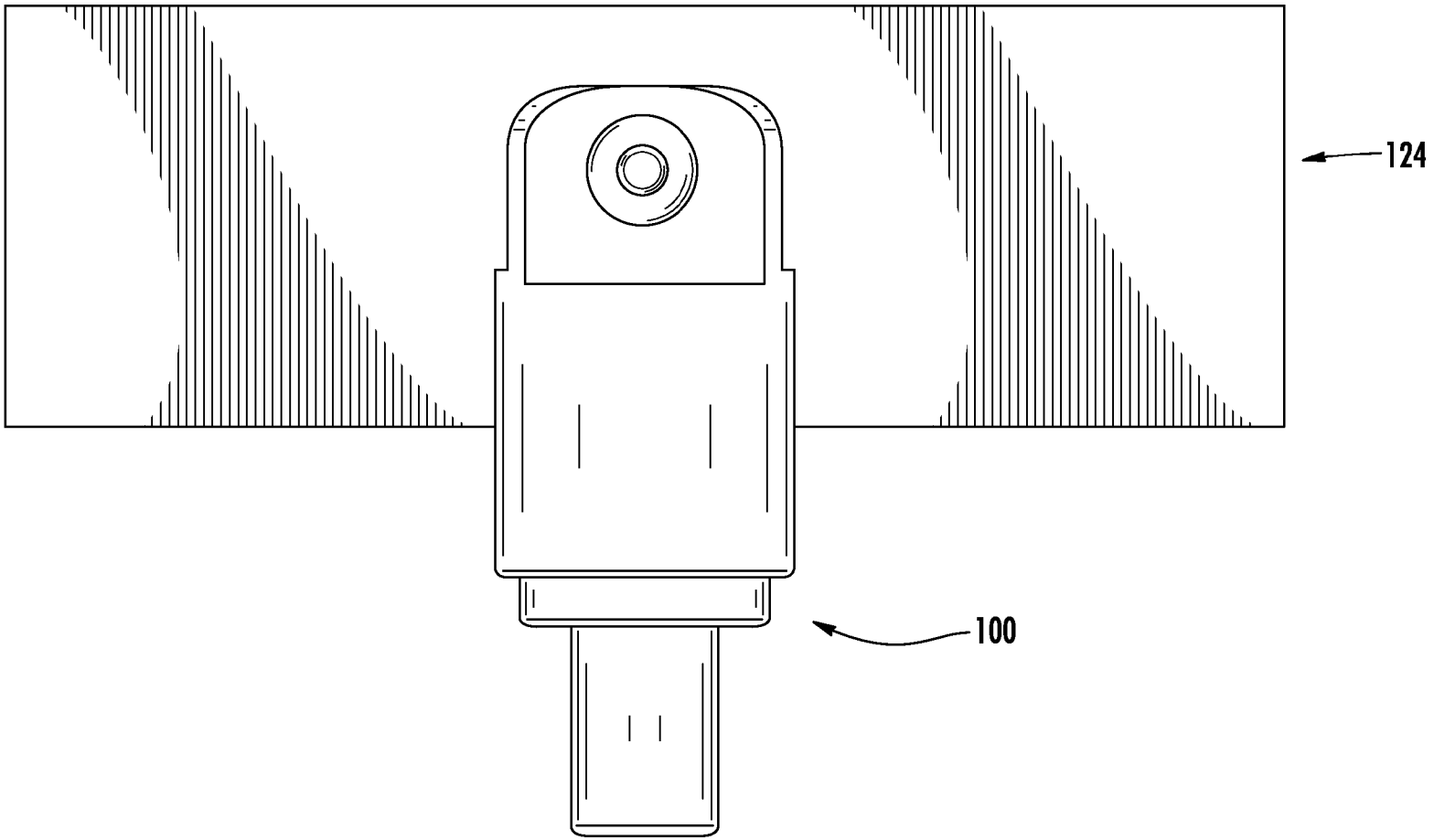
FIG. 5 is a top view of the spring contact assembly and PCB shown in FIG. 3.
Figure 6:
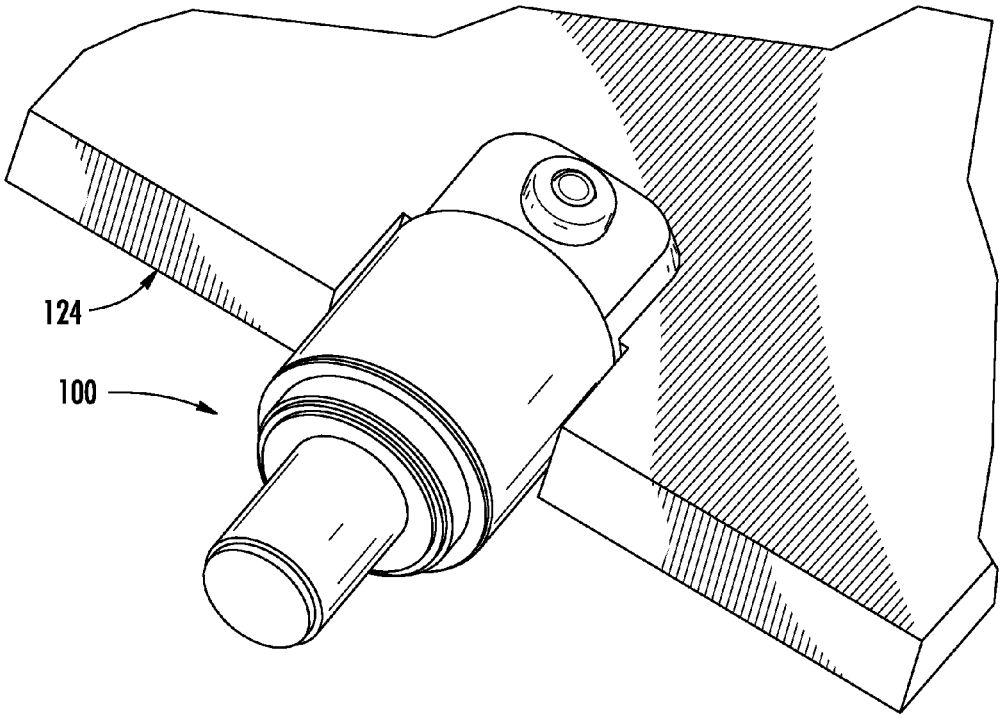
FIG. 6 is a lower perspective view of the spring contact assembly and PCB shown in FIG. 3.

As shown in FIG. 2, the spring contact assembly 100 generally includes a body 104, a spring 108 (broadly, a biasing member), a housing 112 (broadly, contact member), a bearing 116 (broadly, ring or annular member), and a rivet or pin 120 (broadly, a fastener or locking member). FIG. 2 also illustrates the exemplary PCB 124, which is provided with a hole or opening 130 configured for receiving the rivet 120 therein. The PCB 124 also includes a notch or cutout area 132 configured to accommodate positioning of portions 138 of body 104 about the opposite sides of the PCB 124. With this relative positioning, the holes 142 in the body's portions 138 may be aligned with the hole 130 in the PCB 124 for receiving the rivet 120 therethrough.

Figure 7:
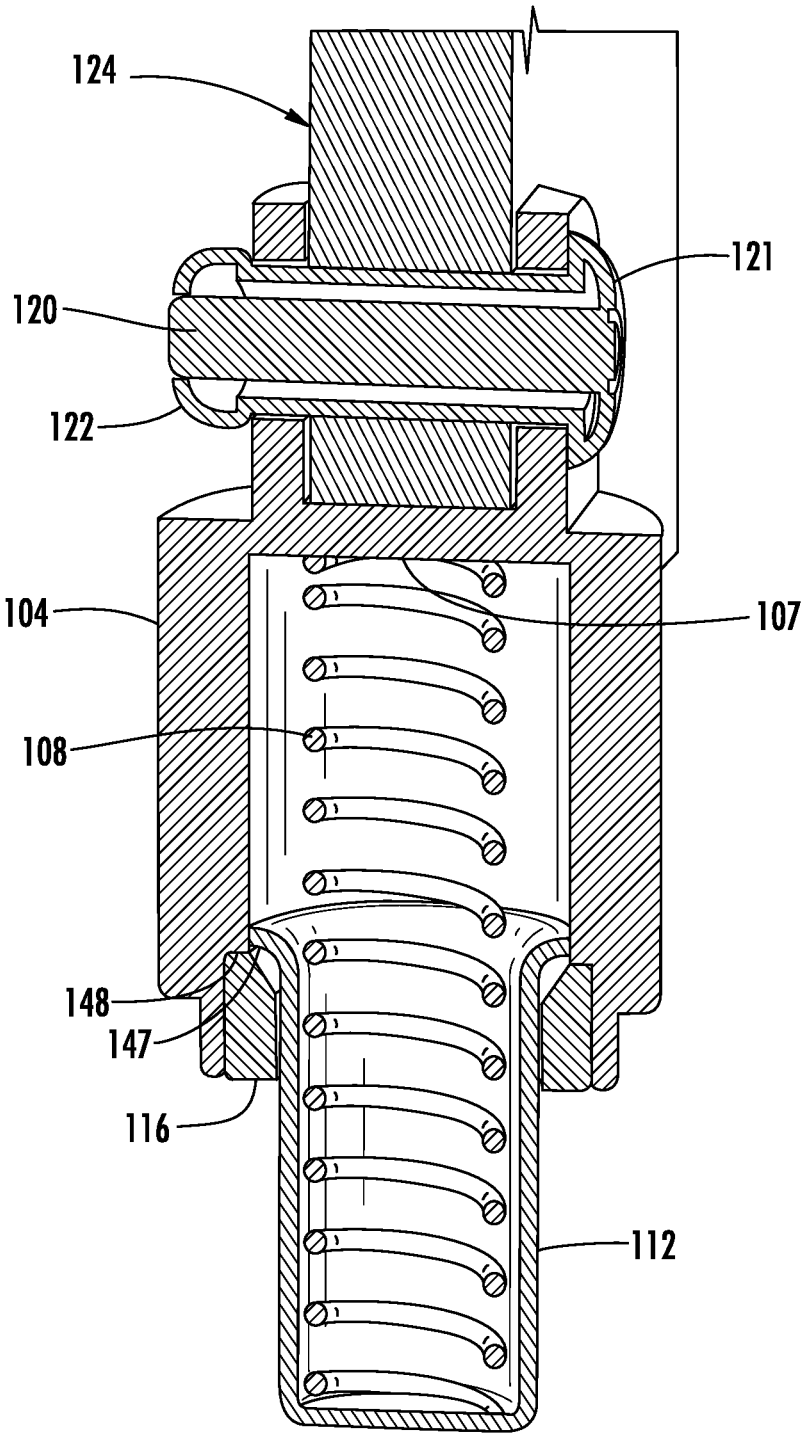
FIG. 7 is a cross sectional view of the spring contact assembly and PCB shown in FIG. 3, and illustrating the spring in an uncompressed, relaxed condition.

When the holes 130, 142 are aligned, the rivet 120 may be positioned through the aligned holes 128, 130 to thereby connect or lock the spring contact assembly 100 to the substrate, board or body of the PCB 124 as shown in FIG. 7. The body's portions 138 and/or rivet 120 may electrically connect with (e.g., galvanically contact, etc.) one or more electrically-conductive portions (e.g., feeding point, radiating element, traces, etc.) of the PCB 124.

Figure 12:
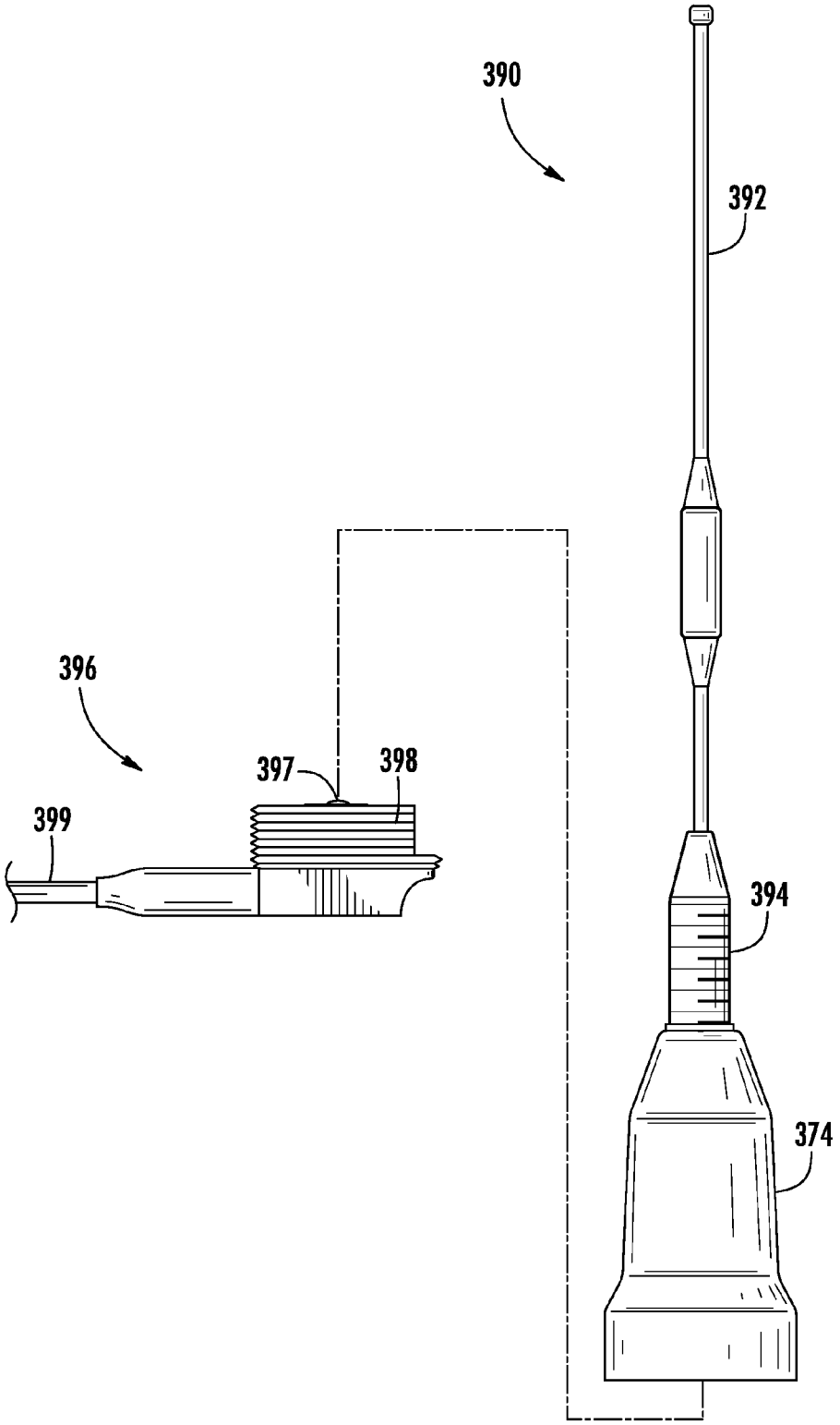
FIG. 12 illustrates an exemplary multiband antenna assembly including the spring contact assembly shown in FIG. 1, the antenna base assembly shown in FIG. 9, and an exemplary external mobile antenna mount according to an exemplary embodiment.

With the spring contact assembly 100 coupled to the PCB 124 via the rivet 120, the other end of the spring contact assembly 100 may by used to physically interconnect or electrically connect with a contact, such as a center contact of an external radio antenna mount (e.g., center contact 397 of antenna mount 396 shown in FIG. 12, etc.). By way of example, the spring contact assembly 100 may connect or mate the center contact of the antenna mount with a feeding point of a radiating element on the PCB 124. In which case, the spring contact assembly 100 may then be used for transferring, transmitting, and/or receiving radio frequency (RF) signals, electrical current, and/or modulated RF signals between an external device (e.g., radio unit connected to the antenna mount 396 via a coaxial cable 399, etc.) and the antenna assembly (e.g., 390 (FIG. 12), etc.) including the spring contact assembly 100.

FIG. 7 illustrates the spring 108 in its initial relaxed, uncompressed condition within the respective open end portions 106, 114 of the body 104 and housing 112 between their respective closed end portions 107, 113. But when the spring contact assembly 100 is assembled between the PCB 124 and the external radio antenna mount, the housing 112 moves or slides at least partially along, within, or into the open end portion 106 tubular body 104 of the spring contact assembly 100 as shown by a comparison of FIGS. 7 and 8. This relative sliding movement of the housing 112 into the body 104 compresses the spring 108 (FIG. 8) between the interior surface of the closed end portion 113 of the housing 112 and the interior surface of the closed end portion 107 of the body 104. With this compression, the spring 108 is operable for providing a biasing force for urging the housing 112 to slide relative to the body 104 in a direction generally away from the closed end portion 107 of the body 104. Accordingly, the spring 108 is thus operable for biasing, pressure loading, or spring loading the housing 112 and its end portion 113 (e.g., contact pin, etc.) into good electrical contact with a center contact of an antenna mount. At which point, the spring contact assembly 100 may thus transfer signals or electrical current between the antenna mount center contact and the PCB 124.

With continued reference to FIG. 2, the various components of this illustrated embodiment of the spring contact assembly 100 will now be described in more detail for this example. The body 104 is cylindrical and electrically-conductive. The body 104 also includes an open end portion 106 and a closed end portion 107. The body 104 also includes generally flat spaced-apart portions or flats 138, which protrude or extend outwardly from the closed end portion 107. These portions 138 include thru holes 142 aligned with each other for receiving the rivet 120 therethrough. The spacing between the body's portions 138 is predetermined or configured so as to be about equal to (e.g., only slightly larger) the thickness of the substrate or board of the PCB 124 to which the spring contact assembly 100 will be mounted. The body's portions 138 may be configured so as to snugly receive or grip the PCB substrate or board therebetween to thereby form an interference or friction fit. The body 104 may be made from any suitable electrically-conductive material, such as metal (e.g., brass, etc.) or other materials.

The spring 108 in this example embodiment is a helical metal compression coil spring made from a stainless steel alloy material. In operation, the spring 108 is operable for biasing or pressure loading the housing 112 and its end portion 113 into good electrical contact with a center contact of an external antenna mount. While this illustrated embodiment includes a coil spring, other suitable biasing members besides coil springs made from stainless steel alloy may be used in other embodiments.

Figure 8:
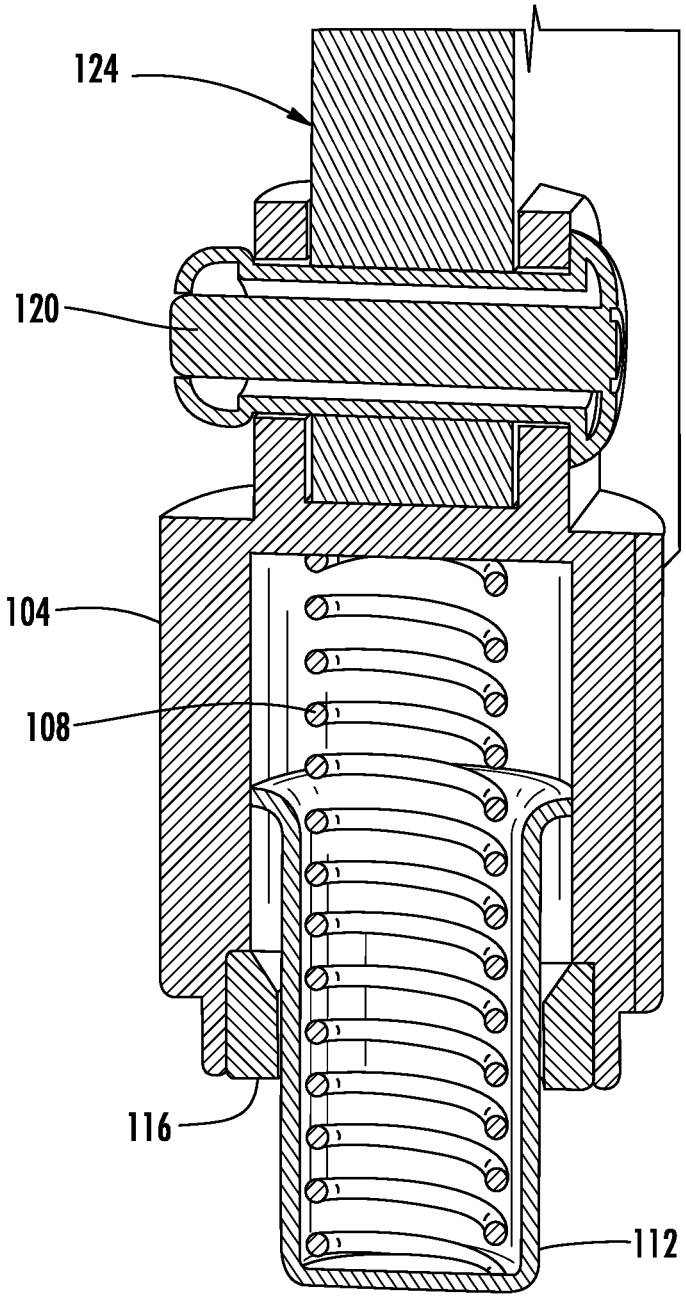
FIG. 8 is another cross sectional view of the spring contact assembly and PCB shown in FIG. 3, but now illustrating the spring in compressed condition.

The housing 112 includes a closed end portion 113 and open end portion 114 for receiving the spring 108 therein as shown in FIGS. 7 and 8. The closed end portion 113 is biased by the spring 108 when compressed (FIG. 8) so that good electrical contact is established and maintained with a center contact of an external antenna mount. In this example, the housing 112 includes a cold drawn cup or cup-shaped member made from brass sheet metal and plated with gold for the purpose of corrosion resistance and maintenance of long term surface contact transitioning RF electrical current. The housing 112 includes a rim or lip 147 that is larger than the central opening of ring or annular member 116, such that the housing 112 is retained to the body 104 and cannot be completely slid out of the body 104.

While this illustrated embodiment includes a cup-shaped cold drawn housing 112 from brass sheet metal plated with gold, other embodiments may include housings with a different configuration, such as housings formed from other materials and/or other manufacturing processes.

Also in this illustrated embodiment, the ring or annular member 116 is a bearing that is inserted into the body 104 so as to provide a bearing surface for rotary and linear movement of the housing 112 relative to the bearing 116 and body 104. The annular member 116 also prevents or at least inhibits the housing 112 from being slid completely out of the body 104. The bearing 116 may be coupled to the inner walls of the body 104 via mechanical compression, interference/friction fit, or other suitable method. As shown in FIG. 7, the bearing 116 is in abutting contact with an internal shoulder 148 of the body 104.

In this example, the rivet 120 is used as a mechanical fastener that couples the spring contact assembly 100 to the PCB 124. The rivet 120 is a permanent or fixed mechanical fastener in this example that it not removable from the holes of the PCB 124 and body 104 after installation. Before being installed, the rivet 120 includes a smooth cylindrical shaft with a head 121 on one end (FIG. 2). The end opposite the head 121 is called the buck-tail 122. During installation, the rivet 120 is placed in the aligned holes 128, 142. Then, the tail 122 of the rivet 120 is upset, bucked, or deformed (as shown by FIG. 7) so that it expands (e.g., to about 1.5 times the original shaft diameter, etc.) thus holding the rivet 120 in place as the both ends 121, 122 are larger than the holes 128, 142 thus preventing the rivet 120 from being removed from the holes 128, 142. To distinguish between the two ends 121, 122 of the rivet 120, the original head is called the factory head 121 and the deformed end is called the shop head or buck-tail 122. While this illustrated embodiment includes the rivet 120 for coupling the spring contact assembly 100 to the PCB 124, other embodiments may include other fasteners besides rivet 120.

Regarding the PCB 124, it may include a substrate or board body made of FR4 or other suitable material. The PCB 124 includes one or more antenna radiating elements (e.g., electrically-conductive traces, etc.) configured to be operable and resonant in one or more frequency ranges or bands, such as a very high frequency (VHF) band from 136 Megahertz (MHz) to 174 MHz, an ultra high frequency (UHF) band from 380 MHz to 520 MHz, and/or a 700/800 MHz band from 760 MHz to 870 MHz. These frequency bands are examples only as other exemplary embodiments may include a PCB with one or more antenna radiating elements configured to be operable and resonant at other frequencies and/or frequency bands.

In operation, the PCB 124 is operable for transmitting and receiving electrical current through a contact port physically attached to an edge of the PCB 124. Also in this illustrated embodiment, the PCB 124 is configured with a specific or predetermined shape to accommodate the installation of the spring contact assembly 100. As shown in FIG. 2, the PCB 124 includes the notch or cutout area 132 configured to accommodate positioning of the portions 138 of the body 104 about the opposite sides of the PCB 124. This positioning allows the holes 142 in the body's portions 138 to be aligned with the hole 130 in the PCB 124.

With continued reference to FIG. 7, the body 104 is used to house and control the linear movement of the housing 112. As shown in FIG. 7, the helical coil spring 108 is placed within the open end portions 106 and 114 of the body 104 and housing 112, respectively, such that the spring 108 is inside the space or void portion between the closed end portion 107 of the body 104 and the closed end portion 113 of the housing 112. The ring 116 is pressed into the inner walls of the contact body 104 to thereby lock or retain the flanged portion 147 of the housing 112. The flat extending portions 138 of the body 104 are positioned into the PCB notch 132 such that the holes 142 of the body's portions 138 line up with the PCB hole 130. The rivet 120 is then inserted through the holes 142, 130, and then the end 122 of the rivet 120 is deployed (e.g., deformed, etc.) to lock or retain the spring contact assembly 120 onto the PCB 124.

Figure 9:
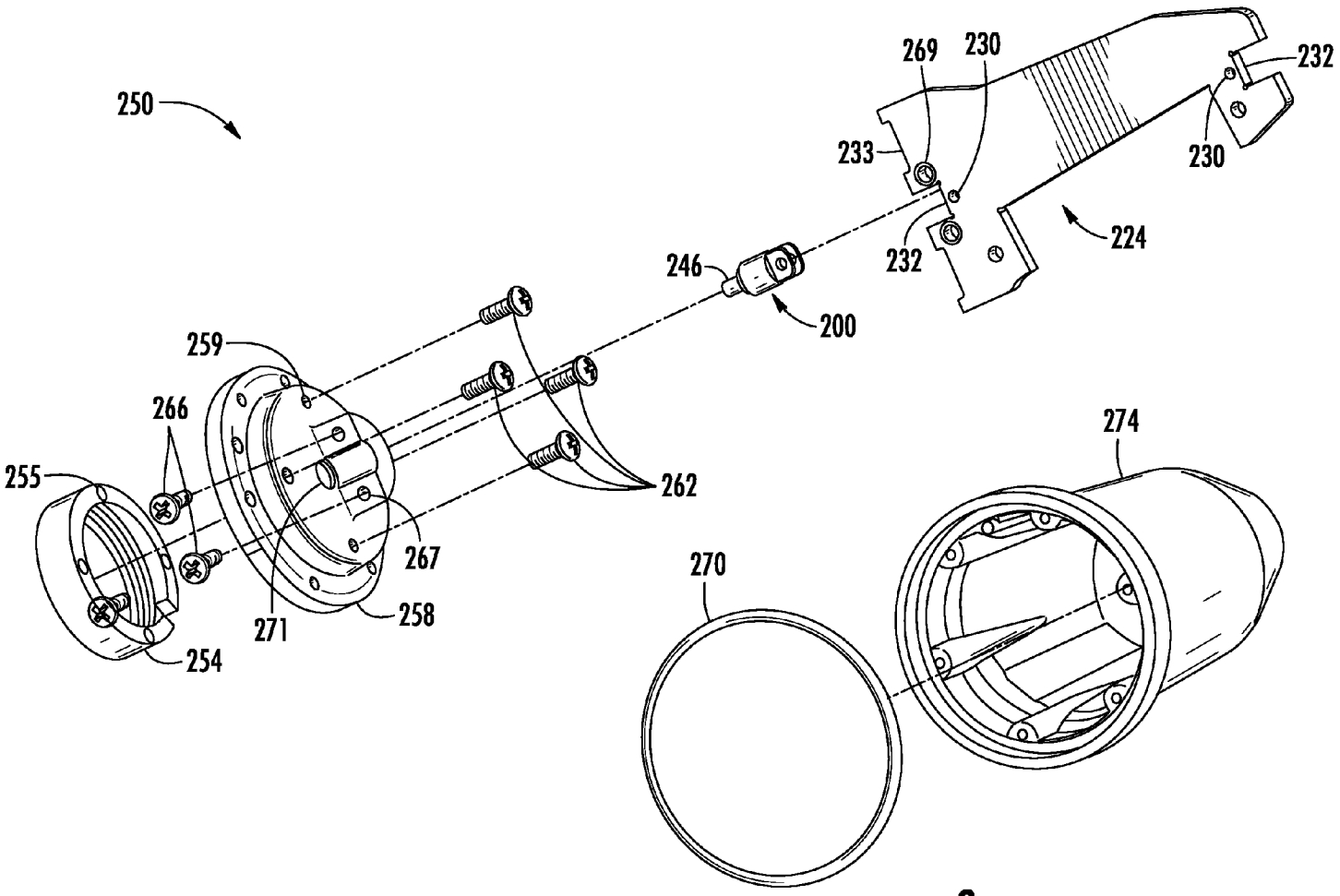
FIG. 9 is an exploded perspective view of an antenna base assembly according an exemplary embodiment.
Figure 10:
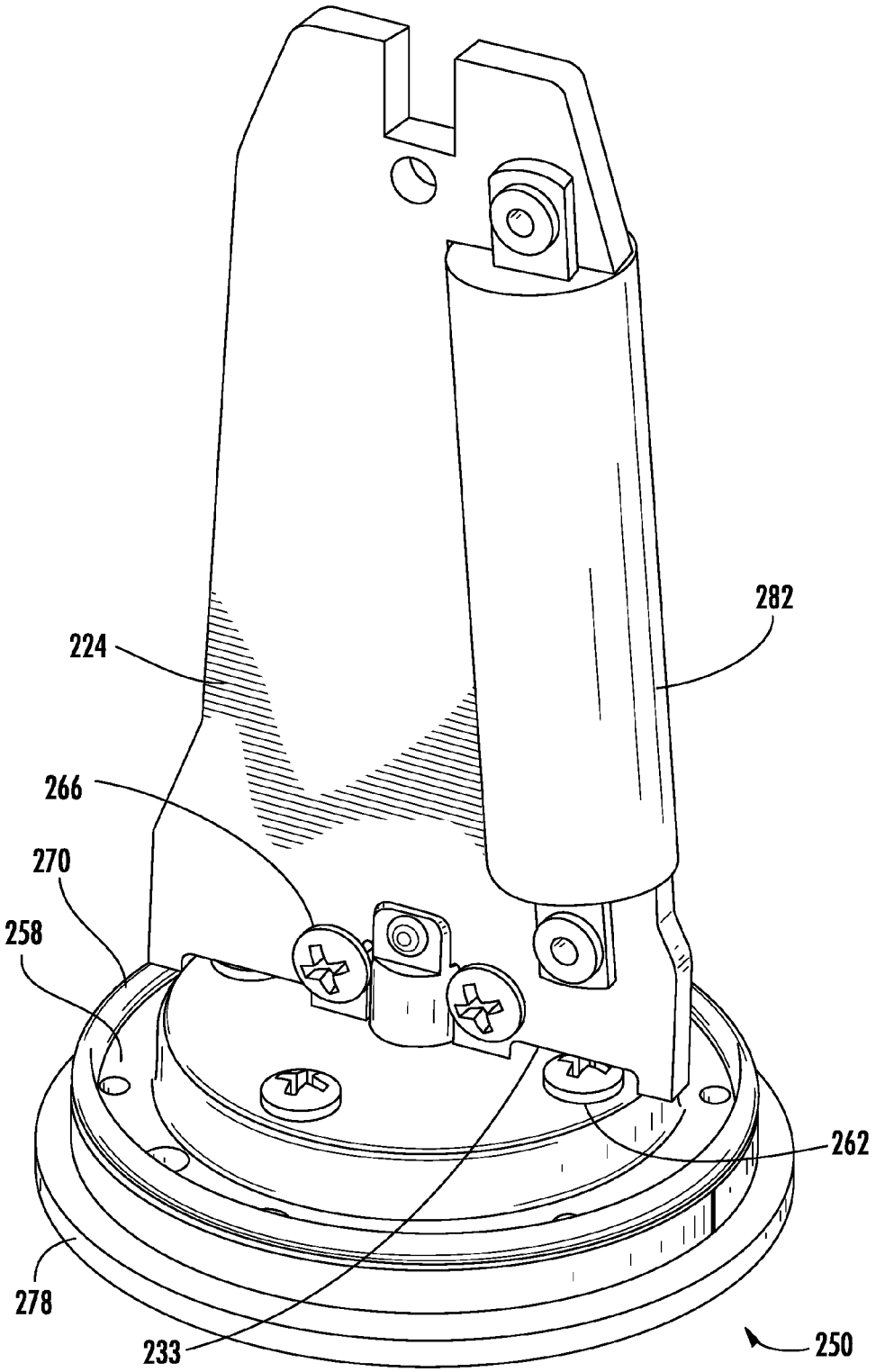
FIG. 10 is a perspective view of the antenna base assembly shown in FIG. 9 after being assembled together.
Figure 11:
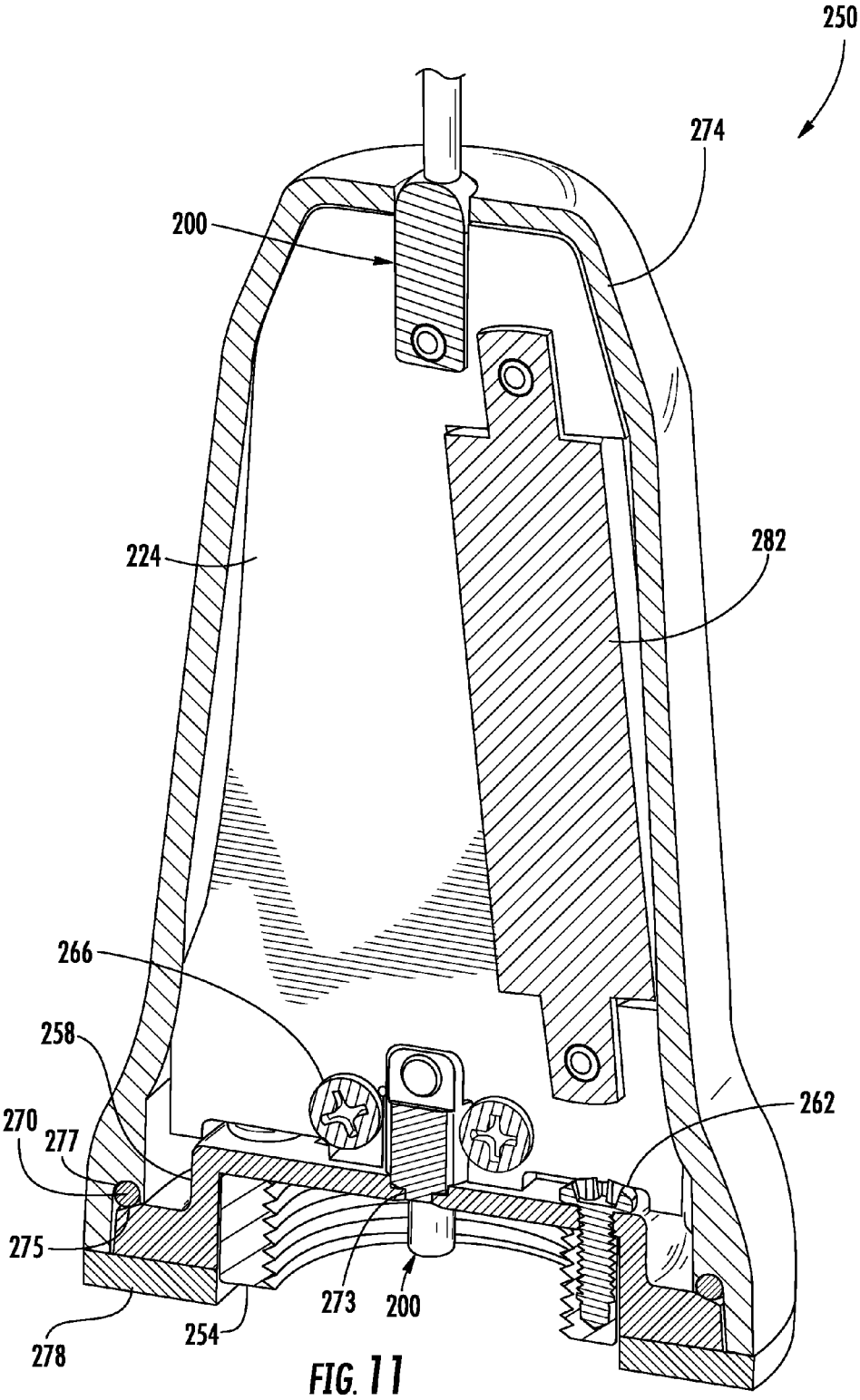
FIG. 11 is a perspective view of the antenna base assembly shown in FIG. 11 with the housing installed.

FIGS. 9 through 11 illustrate an exemplary embodiment of an antenna base assembly 250 embodying one or more aspects of the present disclosure. The antenna base assembly 250 may be used as an adaptor to mate an external antenna mount into a feeding point of a radiating element. As disclosed herein, the antenna base assembly 250 provides multiple electrical grounding sources and also maintains a sealed antenna base (e.g., a moisture and/water sealed base, etc.).

The antenna base assembly 250 may be used in conjunction with a spring contact assembly, such as the spring contact assembly 100 shown in FIG. 1. Additionally, or alternatively, the antenna base assembly 250 may also be used with the multiband antenna assembly 390 shown in FIG. 12. But the antenna base assembly 250 may also be used with other spring contact assemblies and/or other antenna assemblies than what is disclosed herein.

As shown in FIG. 9, the antenna base assembly 250 generally includes a bushing 254 (broadly, an electrically-conductive grounding member) and a base 258. The base 258 includes a seat formed in the bottom thereof for receiving the bushing 254 as shown in FIG. 11. Accordingly, the base 258 may also be referred to as a base seat.

With continued reference to FIGS. 9 through 11, fasteners 262, 266 respectively couple the bushing 254 and PCB 224 to the base 258. The antenna base assembly 250 also includes a sealing member 270 (e.g., an O-ring, gasket, etc.), a contact 200 (e.g., contact pin, spring assembly 100, etc.), and a housing or radome 274 (e.g., bell or dome shaped plastic housing, etc.).

In this illustrated example of FIGS. 9 through 11, the bushing 254 is an electrically-conductive ground bushing formed from metal or other suitable electrically-conductive material. The bushing 254 has a cylindrical, annular shape. The bushing 254 is also drilled or tapped with four threaded holes 255 on the upper side to respectively receive the four electrically-conductive fasteners 262 (e.g., metal screws, etc.). The bushing 254 is also configured (e.g., internally threaded, etc.) to mate with an antenna mount. For example, FIG. 12 illustrates an exemplary antenna mount 396 having a threaded portion 398 onto which the bushing 254 may be threaded. By way of further example, the bushing 254 may be internally threaded to mate with a mobile antenna mount, such as an MBO ¾" NMO mount available from Laird Technologies, Inc. As another example, the bushing 254 may be internally threaded for mating to a New Motorola (NMO) antenna mount installed in a roof, trunk, hood, etc. of a vehicle.

The fasteners 262, 266 may be screws made from solderable material, such as brass, nickel-plated metal, gold-plated metal, tin-plated metal, etc. As shown by FIG. 11, the fasteners 262, 266 are used to fasten the bushing 254 and PCB 224, respectively, to the base 258. Alternatively, other embodiments may include more or less than four fasteners 262, more or less than two fasteners 266, and/or different fasteners besides metal screws for fastening the bushing 254 and PCB 224 to the base 258.

The fasteners 262 are also deployed as electrical grounding taps for the PCB 224 in this example. The fasteners 262 are configured for establishing at least a portion of an electrically-conductive grounding pathway from outside of or external to the interior enclosure of the antenna base assembly 250 and which extends into the interior enclosure. As shown by FIG. 11, the fasteners 262 extend through the holes 259 in the base 258 with the first end portions or heads of the fasteners 262 within the interior enclosure while the other or second end portions are external to the interior enclosure and inserted into holes of the bushing 254. Also, the fasteners 262 are disposed internally to or within the perimeter or footprint of the seal 270, and thus do not breach or otherwise interfere with the sealing providing by the seal 270. The fasteners 262 also do not breach or otherwise interface with the sealing provided by seals 273 or 278 either.

The fasteners 262 may be soldered directly to one or more electrically-conductive portions on the PCB 224 and/or by extending wire leads from the PCB 224 and soldering the wire leads to the ground taps/fasteners 262. In either case, an electrically-conductive grounding pathway is thus established from the PCB 224 through the fasteners 262 to the bushing 254 and then to the threaded portion of the antenna mount on which the bushing 254 is mounted.

The base 258 may be formed from various dielectric materials. By way of example, the base 258 may be an injection molded plastic part configured (e.g., shaped, sized, etc.) to accept the mating of the bushing 254 and the PCB 224. As shown in FIG. 11, the lower portion of the base 258 includes an opening, recess, or seat configured (e.g., sized, shaped, etc.) to receive the bushing 254 therein. The bushing 254 is positionable within the seat of the base 258 such that the bushing 254 is disposed and nests in the seat of the base 258 in a fixed or predetermined orientation. When the bushing 254 is positioned in the seat of the base 258, the holes 255 of the bushing 254 are aligned with holes 259 through the base 258 for receiving the fasteners 262.

The upper or top portion of the base 258 is shaped to mate with the PCB 224 aligned vertically. When the PCB 224 is positioned on the base 258 as shown in FIGS. 10 and 11, holes 267 in the base 258 align with holes 269 in the PCB 224 for receiving the fasteners 266.

The PCB 224 also includes clearances or cutout areas 233 to accommodate and provide sufficient space for the heads of the fasteners 262 as shown in FIG. 10. The PCB 224 may also include one or more antenna radiating elements (e.g., electrically-conductive traces, etc.), one or more matching networks, among other components or portions of an antenna system or network, etc. In this illustrated example shown in FIGS. 10 and 11, the PCB 224 includes an aluminum transformer balun 282, which is a part of the antenna matching circuit in this example.

In addition, the PCB 224 also includes holes or openings 230 and notches or cutout areas 232. These PCB holes 230 and notches 232 may be used similar to that described above for the PCB 124 and spring contact assembly 100. Accordingly, the spring contact assembly 200 shown in FIG. 9 may be identical in structure and/or operation as the spring contact assembly 100 shown in FIGS. 1 through 8. But other embodiments may include a spring contact assembly 200 different than spring contact assembly 100.

With continued reference to FIG. 9, the spring contact assembly 200 (e.g., spring loaded metal contact, etc.) includes an end portion 246 (e.g., a contact pin, etc.). The end portion 246 is configured (e.g., sized, shaped, etc.) to be pressed into an opening or thru hole 271 (e.g., tap hole, etc.) through a center or middle of the base 258, such that a seal or sealed interface 273 (FIG. 11) is formed between the end portion 246 and the sidewalls of the base 258 forming the hole 271. Accordingly, the seal 273 helps prevent or inhibit the ingress or migration of water, moisture, dust, etc. into the inside of the antenna hull or antenna base assembly 250. Other embodiments may include one or more sealing members, (e.g., an O-ring, a resiliently compressible elastomeric or foam gasket, caulk, adhesives, other suitable packing or sealing members, integral sealing features, etc.) for substantially sealing the hole 271 in the base, in addition to or as an alternative to the sealing provided by the end portion 246.

In addition to the sealing function in this example, positioning the end portion 246 of the spring contact assembly 200 through the opening 271 also allows it to electrically connect with a center contact or pin (e.g., center contact 397 shown in FIG. 12, etc.) of an antenna mount when the base assembly 250 is installed onto the antenna mount. In turn, the center contact of the antenna mount may be connected to an inner conductor of a coaxial cable (e.g., coaxial cable 399 also shown in FIG. 12, etc.). And, the coaxial cable may be connected to an electronic device, such as a radio device. The spring contact assembly 200 may thus connect or mate the center contact of the antenna mount with a feeding point of a radiating element on the PCB 224. In operation, the spring contact assembly 200 may thus be operable for transferring electrical current between the center contact of the antenna mount to the antenna radiating element or a network of the antenna assembly that includes the base assembly 250.

In addition to the seal 273 formed between the contact pin 246 and base 258, the antenna base assembly 250 also includes the sealing member or seal 270. In this example, the seal 270 is an elastomeric (e.g., rubber, silicone, foam, etc.) O-ring, gasket, or washer configured so as to seal an interface between the housing 274 and base 258. As shown by FIG. 11, the seal 270 is disposed in a recessed channel, groove, or seat 277 of the antenna housing 274. The seal 270 also abuts or is seated against a shoulder, rim, groove, or seat 275 of the base 258. In this exemplary manner, the seal 270 substantially seals the interface between the housing 274 and base 258, which helps prevent or inhibit the ingress or migration of water, moisture, dust, other contaminants, etc. into the interior enclosure defined between the housing 274 and base 258. Other embodiments may include one or more other sealing members, such as caulk, adhesives, other suitable packing or sealing members, etc. for substantially sealing the interface between the base 258 and housing 274. In other embodiments, sealing may be achieved by one or more integral sealing features rather than with a separate sealing mechanism.

The antenna housing 274 may be coupled to the base 258 by various suitable means, such as mechanical fasteners (e.g., screws, other fastening devices, etc.), a snap-fit connection, ultrasonic welding, solvent welding, heat staking, adhesives, latching, bayonet connections, hook connections, integrated fastening features, etc. within the scope of the present disclosure. When the housing 274 is coupled to the base 258, the seals 270 and 273 may thus help protect components against ingress of contaminants (e.g., dust, moisture, etc.) into an interior enclosure defined between the housing or cover 274 and the base 258. In this illustrated example, the antenna housing 274 is a generally bell shaped or dome shaped plastic housing. Alternative embodiments may include a differently configured housing having a different shape (e.g., aerodynamic configuration, etc.), formed from different materials, etc.

The antenna base assembly 250 may be threadedly coupled via the threaded portion of the bushing 254 to an external antenna mount. In turn, the external antenna mount may be mounted to a surface of an automobile such as the roof, trunk, hood, etc. In the illustrated example, there is shown a sealing member 278 (e.g., a weather resistant rubber or foam gasket, etc.) on the bottom of the antenna assembly 250. In some embodiment, the sealing member 278 may be adhesively attached, etc. to the bottom of the base 258 and/or housing 274.

When the antenna base assembly 250 is mounted the antenna mount, the sealing member 278 is disposed between the mounting surface and the bottom of the antenna base assembly 250. The sealing member 278 may help prevent damage to the vehicle roof (or other mounting surface). The sealing member 278 also provides further sealing features by helping to seal the mounting area against the ingress or migration of moisture, water, dust, etc. In other embodiments, the housing 274 and/or base seat 254 may be mounted to the antenna mount and/or mounting surface without any gasket 278 between the mounting surface and the antenna base assembly.

FIG. 12 illustrates an exemplary multiband antenna assembly 390, which includes the spring contact assembly 100 (FIGS. 1-8) and antenna base assembly 250 (FIGS. 9-11). As shown in FIG. 12, the multiband antenna assembly 390 includes a shock spring 394 above the housing 374 and a whip antenna rod 392 extending thereabove. Also shown in FIG. 12 is an antenna mount 396, which generally includes a center contact 397, a threaded portion 398, and a coaxial cable 399 for connection with an external device, such as a radio unit, etc. The antenna base assembly 250 may be coupled to the antenna mount 396 by threading the bushing 254 onto the threaded portion 398 of the antenna mount 396. Also in this example, a printed circuit board (e.g., 124, 224, etc.) internal to the housing 374 may be connected to the center contact 397 and to the whip antenna rod 392 via two spring contact assemblies 100 along the bottom and top of the printed circuit board. Accordingly, the spring contact assemblies 100 may be used for transferring, transmitting, and/or receiving radio frequency (RF) signals, electrical current, and/or modulated RF signals between an external device (e.g., radio unit, etc.) and the antenna assembly 390.

The multiband antenna assembly 390 may be configured to be operable and resonant in various frequency ranges or bands, including a very high frequency (VHF) band from 136 MHz to 174 MHz, an ultra high frequency (UHF) band from 380 MHz to 520 MHz, a cell/LTE 700/800 MHz band from 764 MHz to 870 MHz. These frequency bands are examples only as other exemplary embodiments of an antenna assembly that includes a spring contact assembly 100 and/or antenna base assembly 250 may be configured to be operable and resonant at other frequencies and/or frequency bands.

Exemplary spring contact assemblies disclosed herein were developed by the inventors in an effort to an effective pressure electrical/mechanical connection point that deploys a minimal (or at least reduced) surface area variation, ease of manufacturing, electrical stability, and/or better (or at least satisfactory) structural strength as compared to some conventional contact assemblies. The inventors hereof recognized that some conventional contact assemblies were associated with one or more of the following drawbacks, such as an inability to handle high electrical current and power requirements, non-uniform contact area and path produced instable repeatability for electrical current flow, operator skill dependent, insufficient structural strength, production reproducibility issues eliminated the fixed tune options on higher frequency antenna models, time consuming assembly process, and/or very difficult to automate at a mass production level.

Accordingly, the inventors have disclosed exemplary embodiments of spring contact assemblies that may provide one or more (but not necessarily any) of the following advantages. For example, an exemplary embodiment of the inventors' spring contact assembly may provide good electrical contact via a rivet, may provide a strong connection to the PCB board material (e.g., FR4, etc.) without concern for cracking of non-existent solder, and/or may provide good repeatability in manufacture and a fixed tune design such that the antenna assemblies do not need to be tuned on the assembly floor during manufacture. By way of further example, an exemplary embodiment of the inventors' spring contact assembly may have a fixed shape that minimizes or reduces electrical RF current flow through the body of the conductive spring contact assembly and surface current flow variation/transformation when repeated in mass production levels. An exemplary embodiment of the inventors' spring contact assembly may provide a solderless interconnection that helps eliminate (or at least reduce) workmanship related variations. An exemplary embodiment of the inventors' spring contact assembly may have a stronger structure to minimize or reduce the possibility of disengagement from the PCB. An exemplary embodiment of the inventors' spring contact assembly may provide a two sided sandwich lock to minimize or reduce copper trace peeling effects due to vibrations. An exemplary embodiment of the inventors' spring contact assembly may be configured with a rivet fastened lock that constrains the structure to a stronger FR4 material of the board of the PCB and not to the copper trace. An exemplary embodiment of the inventors' spring contact assembly may be configured with a spring contact feature that can handle up to five hundred percent more impact and loading forces than a convention soldered type pushpin. An exemplary embodiment of the inventors' spring contact assembly may contain a heavier section of materials allowing higher electrical current to run through, which, in turn would allow higher power handling. An exemplary embodiment of the inventors' spring contact assembly may not require any additional mechanical support from the hull body of the containing unit. An exemplary embodiment of the inventors' spring contact assembly may allow for a faster assembly and easier automation possibilities. It should be noted that the advantages disclosed herein are exemplary only and not limiting, as exemplary embodiments of the present disclosure may achieve all, some, or none of the advantages disclosed herein.

The inventors hereof have also recognized conventional antenna base assemblies provide electrical grounding but suffered many problems associated with poor seals and/or breached seals, which made the antenna prone to failure. For example, some conventional antenna base assemblies are associated with a shorter life span on shelf or in the field, a degraded performance by time caused by internal component corrosion, an open antenna hull allowing moisture condensation inside the antenna associated with temperature variation, imminent failure if mounted high or poorly, allow water migration from rain hydro pressure to seep into the antenna, imminent failure if the base gasket fails, and/or allowed only one grounding tap to feed the PCB.

Accordingly, the inventors have disclosed exemplary embodiments of sealed antenna base assemblies that may provide one or more (but not necessarily any) of the following advantages. For example, an exemplary embodiment of the inventors' sealed antenna base assembly may provide more than one grounding tap, may maintain long term performance with minimized (or at least reduced) corrosion of internal components of an antenna unit, may provide a stronger uphold against moisture and water migration into the inside the antenna unit, may minimize or reduce moisture condensation due to thermal variation, may significantly reduce the chance for failures if mounted high or poorly, may double the sealing defense to insure no failures if the base gasket fails, may significantly increase storage shelf life and infield life span, and/or enabled the antenna structure to meet higher standards such as Ingress Protection ratings. It should be noted that the advantages disclosed herein are exemplary only and not limiting, as exemplary embodiments of the present disclosure may achieve all, some, or none of the advantages disclosed herein.

Numerical dimensions and values are provided herein for illustrative purposes only. The particular dimensions and values provided are not intended to limit the scope of the present disclosure.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A contact assembly suitable for providing a solderless connection between a contact of an antenna mount and a printed circuit board of an antenna assembly mountable to the antenna mount, the contact assembly comprising:

a body having an open end portion, a closed end portion, and spaced-apart portions extending outwardly from the closed end portion, the spaced-apart portions having holes therethrough and configured to be positioned about opposite sides of a printed circuit board for aligning the holes of the spaced-apart portions with a hole in the printed circuit board;

a fastener configured to be positioned within the aligned holes of the spaced-apart portions of the body and printed circuit board for coupling the contact assembly to the printed circuit board;

a contact member having an open end portion and closed end portion, the contact member coupled to the body such that the contact member is slidable at least partially within the open end portion of the body; and a biasing member disposed within the open end portions of the body and the contact member between the closed end portions of the body and the contact member, whereby the biasing member is operable for providing a biasing force for urging the contact member to slide relative to the body in a direction generally away from the closed end portion of the body when the biasing member is compressed between the closed end portions of the contact member and body.

2. The contact assembly of claim 1, wherein:

the closed end portion of the contact member is configured for electrical contact with a contact of an antenna mount; and the biasing member is operable for biasing the closed end portion of the contact member against the contact to thereby help establish and maintain an electrical connection therebetween.

3. The contact assembly of claim 1, wherein the biasing member comprises a coil spring operable for spring loading the contact member and its closed end portion into electrical contact with a contact of an antenna mount.

4. The contact assembly of claim 1, wherein the fastener comprises a rivet.

5. The contact assembly of claim 1, further comprising an annular member having an opening through which a portion of the contact member is received, wherein the annular member is disposed within the open end portion of the body to thereby provide a bearing surface for allowing rotary and linear movement of the contact member relative to the annular member and body.

6. The contact assembly of claim 5, wherein the contact member includes a perimeter lip along the open end portion of the contact member, and wherein the perimeter lip is larger than the opening of the annular member such that the contact member is constrained from sliding completely out of the body.

7. The contact assembly of claim 6, wherein:

the body, the contact member, and the annular member are electrically-conductive;

the fastener comprises a rivet; and the biasing member comprises a helical metal compression spring.

8. An antenna assembly including the contact assembly of claim 1, and further comprising an antenna mount and a printed circuit board connected to the antenna mount via the contact assembly without solder, whereby the contact assembly is operable for allowing transfer of signals between an antenna element of the printed circuit board and a contact of the antenna mount.

9. The antenna assembly of claim 8:

wherein the antenna mount comprises an external mobile antenna mount having a center contact, the external mobile antenna mount configured to be installed to a mounting surface of a vehicle and connected to an electronic device within the vehicle;

wherein the printed circuit board includes a hole and at least one antenna element internal to a housing of the antenna assembly;

wherein the printed circuit board is coupled to the contact assembly by the fastener disposed within the aligned holes of the spaced-apart portions of the body and the printed circuit board; and wherein the closed end portion of the contact member is biased against the center contact by the biasing member such that signals are transferable via the contact assembly between the at least one antenna element and the electronic device that is connected to the center contact of the external mobile antenna mount.

10. An antenna assembly including the contact assembly of claim 1 and further comprising a printed circuit board including:

a hole configured to receive a portion of the fastener therein; and a notch configured to accommodate positioning of the spaced-apart portions of the body about opposite sides of the printed circuit board to thereby align the hole of the printed circuit board with the holes of the spaced-apart portions;

wherein the spaced-apart portions of the body are on the opposite sides of the printed circuit board with the holes of the spaced-apart potions aligned with the hole of the printed circuit board; and wherein the printed circuit board is coupled to the contact assembly by the fastener being disposed within the aligned holes of the printed circuit board and the spaced-apart portions of the body.

11. The antenna assembly of claim 10, wherein:

the spaced-apart portions of the body are spaced apart by a distance about equal to a width of the printed circuit board such that an interference or friction fit is formed between the printed circuit board and space-apart portions of the body when positioned about the opposite sides of the printed circuit board; and/or the fastener and/or the spaced-apart portions of the body are configured to galvanically contact one or more electrically-conductive portions of the printed circuit board.

12. An antenna assembly mountable to an antenna mount having a contact, the antenna assembly comprising:

a printed circuit board including at least one antenna element and at least one hole therethrough; and a contact assembly configured to provide a solderless connection between the at least one antenna element of the printed circuit board and the contact of the antenna mount when the antenna assembly is mounted to the antenna mount, the contact assembly comprising:

a first end portion having at least one hole therethrough aligned with the at least one hole of the printed circuit board, the first end portion fastened to the printed circuit board by at least one fastener disposed with the aligned holes, the first end portion having an open portion;

a second end portion configured to electrical contact the contact of the antenna mount, the second end portion having an open portion; and a biasing member between the first and second end portions, the biasing member disposed within the open portions of the first and second end portions, the biasing member operable for biasing the second end portion against the contact of the antenna mount when the antenna assembly is mounted to the antenna mount.

13. The antenna assembly of claim 12, wherein the antenna assembly is mounted to the antenna mount such that the contact assembly is operable for allowing transfer of signals between the antenna element of the printed circuit board and the contact of the antenna mount.

14. The antenna assembly of claim 13, wherein the antenna assembly includes:

a base having an opening therethrough and one or more holes;

a housing coupled to the base such that an interior enclosure is cooperatively defined by the housing and the base; and one or more electrical grounding taps for the printed circuit board which is within the interior enclosure, the one or more electrical grounding taps configured for establishing at least a portion of an electrically-conductive grounding pathway from outside the interior enclosure and which extends internally into the interior enclosure by extending through the one or more holes in the base;

wherein the antenna assembly is configured such that the interior enclosure is sealed to thereby inhibit the ingress of water into the interior enclosure; and wherein the second end portion of the contact assembly extends through the opening in the base to make electrical contact with the contact of the antenna mount, which is external to the interior enclosure.

15. An antenna assembly mountable to an antenna mount, the antenna assembly comprising:

a base having a plurality of holes;

a housing configured to be coupled to the base such that an interior enclosure is cooperatively defined by the housing and the base, the interior enclosure configured for receiving a printed circuit board therein and being sealed to thereby inhibit the ingress of water into the interior enclosure; and one or more electrical grounding taps configured for establishing at least a portion of an electrically-conductive grounding pathway from outside the interior enclosure and which extends internally into the interior enclosure by extending through one or more of the plurality of holes in the base, whereby the one or more electrical grounding taps allow the interior enclosure to remain sealed against the ingress of water.

16. The antenna assembly of claim 15, wherein the one or more electrical grounding taps comprise a plurality of fasteners each having a head and an end portion opposite the head, wherein the plurality of fasteners are configured to extend through the plurality of holes in the base with the heads of the fasteners within the interior enclosure and with the end portions external to the interior enclosure.

17. The antenna assembly of claim 15, wherein:

the antenna assembly further includes a printed circuit board within the interior enclosure cooperatively defined by the housing and the base;

the antenna assembly is mounted to the antenna mount; and the one or more electrical grounding taps are electrically connected to the printed circuit board and the antenna mount, such that an electrically-conductive grounding pathway is established from the printed circuit board, which is within the interior enclosure, through the one or more electrical grounding taps to the antenna mount, which is external to the interior enclosure.

18. The antenna assembly of claim 17, wherein the one or more electrical grounding taps are electrically connected to the printed circuit board by soldering and/or one or more wire leads extending between the one or more electrically-conductive grounding taps and one or more electrically-conductive portions of the printed circuit board.

19. The antenna assembly of claim 15, wherein:

the antenna assembly further includes a bushing having a plurality of openings therein;

the base includes a lower portion configured to receive the bushing therein such that the bushing nests in the lower portion of the base in a predetermined orientation in which the holes in the base align with the openings in the bushing; and the one or more electrical grounding taps comprise a plurality of fasteners configured to be positioned through the holes in the base and into the aligned openings in the bushing for coupling the bushing to the base.

20. The antenna assembly of claim 19, wherein:

the bushing is coupled to the base by the fasteners and configured to mate with the antenna mount and thereby mount the antenna assembly to the antenna mount; and the antenna assembly further includes a printed circuit board within the interior enclosure cooperatively defined by the housing and the base coupled the housing; and the printed circuit board includes one or more electrically conductive portions electrically connected to the fasteners, such that an electrically-conductive grounding pathway is established from the one or more electrically-conductive portions of the printed circuit board through the fasteners to the bushing, which is external to the interior enclosure.

21. The antenna assembly of claim 15, further comprising a sealing member configured to be positioned between portions of the housing and the base for sealing an interface between the housing and the base to thereby inhibit the ingress of water through the interface into the interior enclosure, and with the one or more electrical grounding taps entirely disposed within a perimeter of the sealing member without breaching the sealing provided by the sealing member.

22. The antenna assembly of claim 15, wherein:

the base includes an opening therethrough; and the antenna assembly further includes a contact assembly comprising:

a first end portion configured to be coupled to a printed circuit board within the interior enclosure; and a second end portion configured to be positioned through the opening in the base to make electrical contact with a contact of the antenna mount which is external to the interior enclosure and to seal the opening against the ingress of water into the interior enclosure.

23. The antenna assembly of claim 15, further comprising:

a printed circuit board within the interior enclosure cooperatively defined by the housing and the base coupled to the housing, the printed circuit board including at least one antenna element;

a sealing member positioned between portions of the housing and the base so as to seal an interface between the housing and the base to thereby inhibit the ingress of water through the interface into the interior enclosure;

a bushing having a plurality of openings therein and configured to mate with the antenna mount; and a contact assembly including a first end portion coupled to the printed circuit board and a second end portion positioned through an opening in the base to make electrical contact with a contact of the antenna mount which is external to the interior enclosure and to seal the opening in the base against the ingress of water into the interior enclosure;

wherein the base includes a lower portion configured to receive the bushing therein such that the bushing nests in the lower portion of the base in a predetermined orientation in which the holes in the base align with the openings in the bushing;

wherein the one or more electrical grounding taps comprise a plurality of fasteners positioned through the holes in the base and into the aligned openings in the bushing to thereby fasten the base to the bushing, which is disposed within the lower portion of the base;

wherein the fasteners are disposed within a perimeter of the sealing member without breaching the seal providing by the sealing member; and wherein the printed circuit board includes one or more electrically conductive portions electrically connected to the fasteners, such that an electrically-conductive grounding pathway is established from the one or more electrically-conductive portions of the printed circuit board, which is within the interior disclosure through the fasteners that extend through the base and to the bushing, which is external to the interior enclosure.

24. The antenna assembly of claim 23, wherein:

the antenna mount comprises an external mobile antenna mount having a center contact and a threaded portion, the external mobile antenna mount configured to be installed to a mounting surface of a vehicle and connected to an electronic device within the vehicle;

the bushing is internally threaded to mate with the threaded portion of the external mobile antenna mount to thereby mount the antenna assembly to the antenna mount;

the openings of the bushing are threaded;

the plurality of fasteners comprise a plurality of screws each having a head and an end portion opposite the head, wherein the plurality of screws are configured to extend through the plurality of holes in the base with the heads of the fasteners within the interior enclosure and with the end portions external to the interior enclosure and inserted into the threaded openings of the bushing; and the contact assembly provides a solderless connection between the at least one antenna element of the printed circuit board and the center contact of the antenna mount.

* * * * *